US007007731B2

(12) United States Patent
Chiu et al.

(10) Patent No.: US 7,007,731 B2
(45) Date of Patent: Mar. 7, 2006

(54) BASE FRAME FOR FIXTURE

(76) Inventors: Ming-Hsiang Chiu, No. 459-6, Chung Shan Rd., Shen Kang, Taichung 429 (TW); Hsu Hsiu-Kwei Liu, No. 459-6, Chung Shan Rd., Shen Kang, Taichung 429 (TW)

( * ) Notice: Subject to any disclaimer, the term of this patent is extended or adjusted under 35 U.S.C. 154(b) by 188 days.

(21) Appl. No.: 10/761,289

(22) Filed: Jan. 22, 2004

(65) Prior Publication Data

US 2005/0161113 A1 Jul. 28, 2005

(51) Int. Cl.
*B27M 3/00* (2006.01)

(52) U.S. Cl. ..... 144/372; 144/371; 144/144.1; 269/1; 269/901; 409/178; 33/562; 33/464; 33/478

(58) Field of Classification Search ..... 144/144.51, 144/144.52, 144.1, 145.1, 372, 371; 269/1, 269/901, 295; 409/178, 179; 108/143; 384/55, 384/57, 69, 42; 33/562, 427, 464, 478, 374
See application file for complete search history.

(56) References Cited

U.S. PATENT DOCUMENTS 4,062,123 A * 12/1977 Lundquist ..... 409/130
5,345,986 A * 9/1994 Kieffer ..... 144/372
5,682,934 A * 11/1997 Rybski ..... 144/144.51
5,890,524 A * 4/1999 Tucker et al. ..... 144/371
6,588,468 B1 * 7/2003 Tucker et al. ..... 144/372
6,622,997 B1 * 9/2003 Emerson ..... 269/166

* cited by examiner

*Primary Examiner*—Bena B. Miller

(74) *Attorney, Agent, or Firm*—Troxell Law Office, PLLC

(57) ABSTRACT

A base frame for holding fixtures used in woodwork includes an extruded body having a raised top central portion formed into a dovetailed open-topped upper channel, two lowered wing portions located at each lateral side of the upper channel and formed into two symmetrically identical open-topped side channels with a height difference between the tops of the upper and the side channels, and a big-size open-bottomed lower channel formed below said upper channel and said two side channels. With the height difference between the upper and the side channels, two base frames may be perpendicularly connected to each other in the same plane using a U-shaped connecting bracket flush with the top of the upper channel, or superposed with the upper channels facing toward each other by locking inserting blocks in each open-sided channel formed between two side channels at the same side of the two superposed base frames.

5 Claims, 14 Drawing Sheets

BASE FRAME FOR FIXTURE

FIELD OF THE INVENTION

The present invention relates to a base frame for holding fixtures used in woodwork. The base frame includes an extruded body having a raised top central portion formed into a dovetailed open-topped upper channel, two lowered wing portions located at each lateral side of the upper channel and formed into two symmetrically identical open-topped side channels with a height difference existed between the tops of the upper and the side channels, and a big-size open-bottomed lower channel formed below said upper channel and said two side channels. With the height difference between the upper and the side channels, two base frames may be perpendicularly connected to each other in the same plane using a U-shaped connecting bracket flush with the top of the upper channel, or superposed with the upper channels facing toward each other by locking inserting blocks in each open-sided channel formed between two side channels at the same side of the two superposed base frames.

BACKGROUND OF THE INVENTION

Specific fixtures are required in woodwork to firmly clamp a workpiece in place, so that accurate, quick, and convenient drilling and groove-milling works may be performed on the workpiece at desired positions. FIG. 1 is a cross sectional view of a conventional base frame for fixture disclosed in U.S. Pat. No. 6,622,997 B2. The conventional base frame for fixture in FIG. 1 is an extruded member having integrally formed upper channel A and lower channel B. A fixture C is inserted in and engaged with the lower channel B, so as to firmly hold a workpiece in place; and a drill rest E is engaged with the upper channel A via connecting brackets D, so that drilling works may be performed. With the above-described structure, the conventional base frame for fixture of FIG. 1 may only clamp the workpiece in a simple manner to perform only the drilling work, and does not have the groove-milling or other function. The conventional base frame for fixture shown in FIG. 1 is therefore not very ideal for woodwork. It is therefore tried by the inventor to develop an improved base frame for fixture that is multi-functional and more convenient for use as compared with the conventional product.

SUMMARY OF THE INVENTION

A primary object of the present invention is to provide an improved base frame for fixture. The base frame includes an extruded body having an integrally formed lower channel, to which different fixtures may be connected, and two open-topped side channels integrally formed at two lower lateral sides of a raised upper channel. With the side channels, two base frames for fixture may be perpendicularly connected to one another at their adjacent edges.

With the above-described structure, two base frames for fixture according to the present invention may also be superposed with the upper channels facing toward each other, so that the two open-topped side channels at the same side of the superposed base frames together define an open-sided channel between them. Using specially designed inserting blocks, washers, and knob-head bolts at the open-sided channels, the two superposed base frames may be detachably connected to one another.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
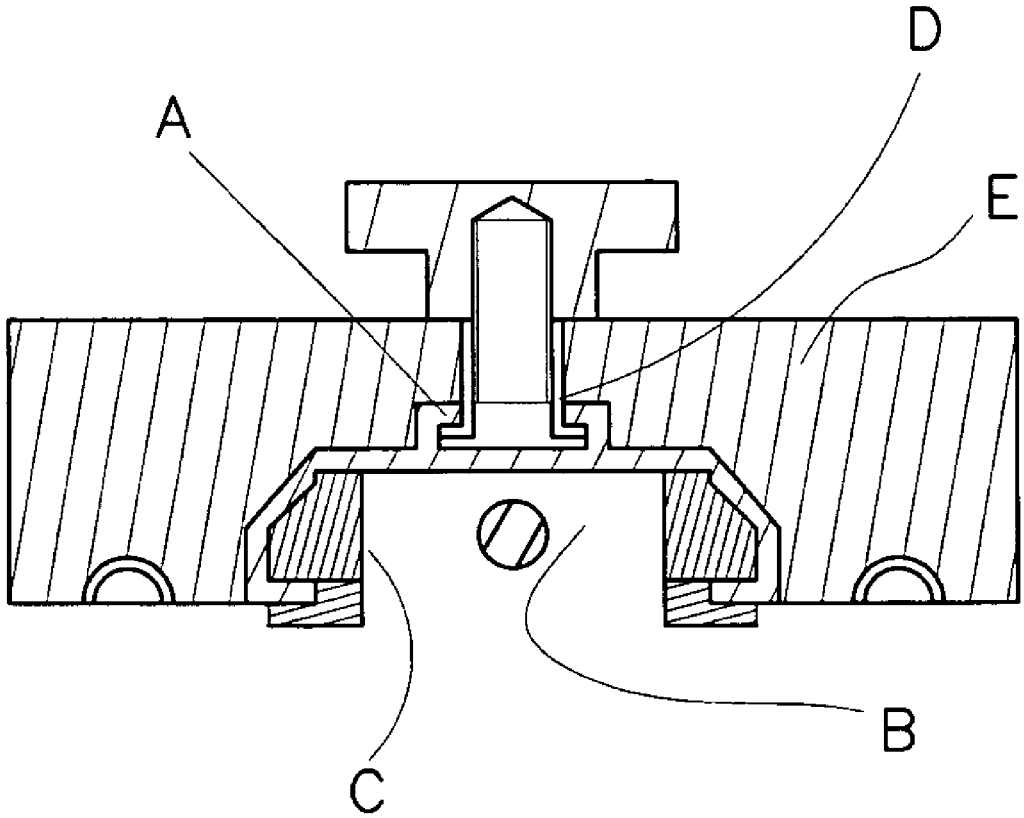
FIG 1 PRIOR ART
FIG. 1 is a cross sectional view of a conventional base frame for fixture.
Figure 2:
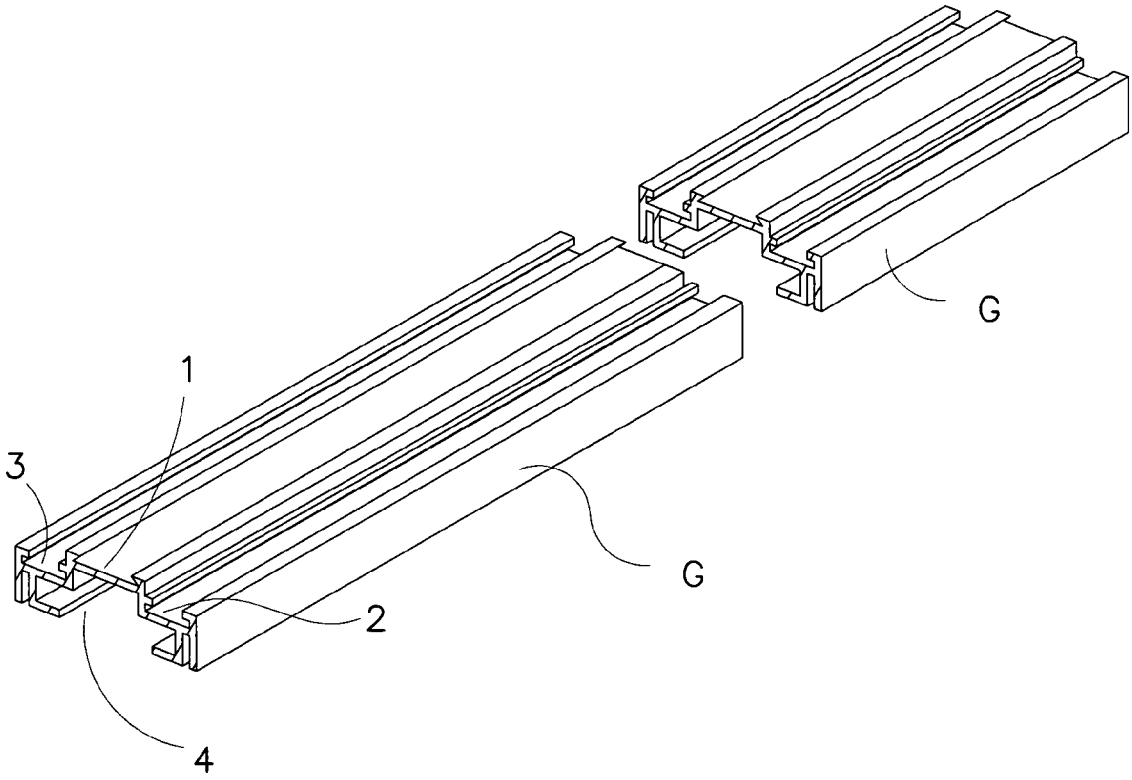
FIG. 2 is a sectioned perspective view of a base frame for fixture according to the present invention.

Please refer to FIG. 2. A base frame for fixture G according to the present invention is an extruded body having a raised top central portion and a lowered wing portion at each lateral side of the raised top central portion. The top central portion of the base frame G is an open-topped upper channel 1 in the form of a dovetail groove having a predetermined depth. The two lowered lateral wing portions are formed into two symmetrically identical open-topped side channels 2, 3. And, a large-size open-bottomed lower channel 4 is formed below the upper channel 1 and the two side channels 2, 3.

Figure 5:
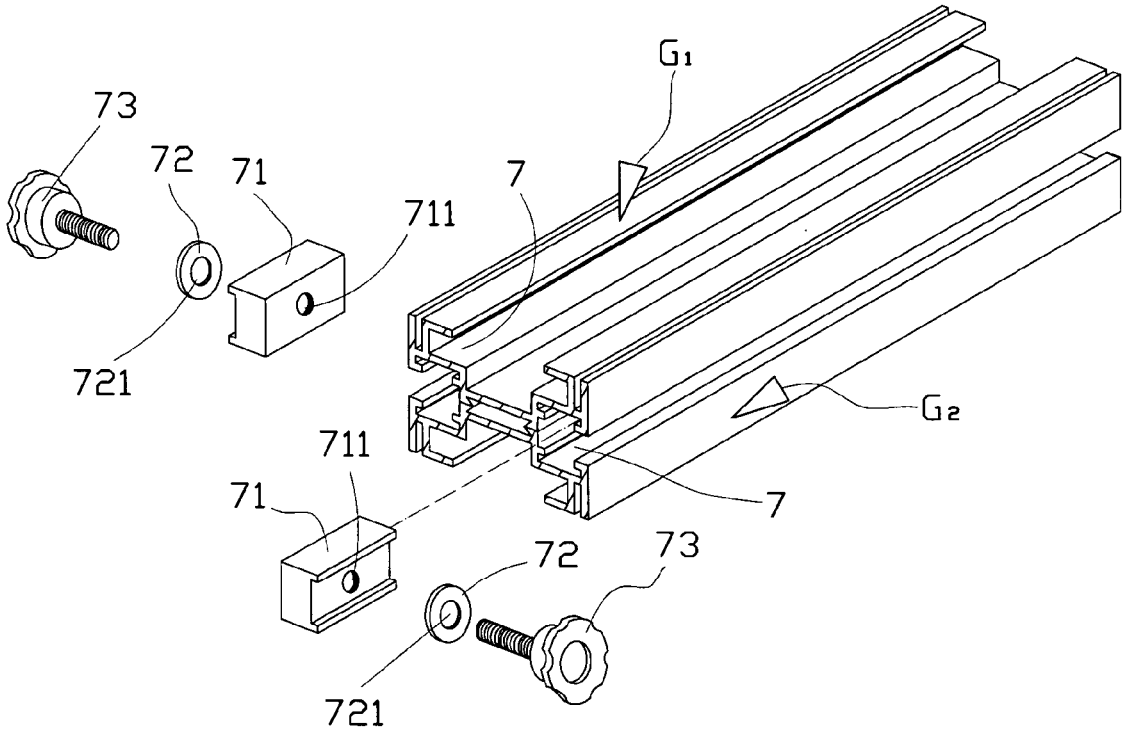
FIG. 5 is an exploded perspective view showing the relation between two superposed base frames for fixture of the present invention and specially designed inserting blocks, washers, and knob-head bolts.

Please refer to FIG. 5. Two base frames $G_1$, $G_2$ may be symmetrically superposed with two upper channels 1 facing toward each other, so that the open-topped side channels 2, 3 at the same side of the superposed base frames $G_1$, $G_2$ together define an open-sided channel 7 between them.

Figure 3:
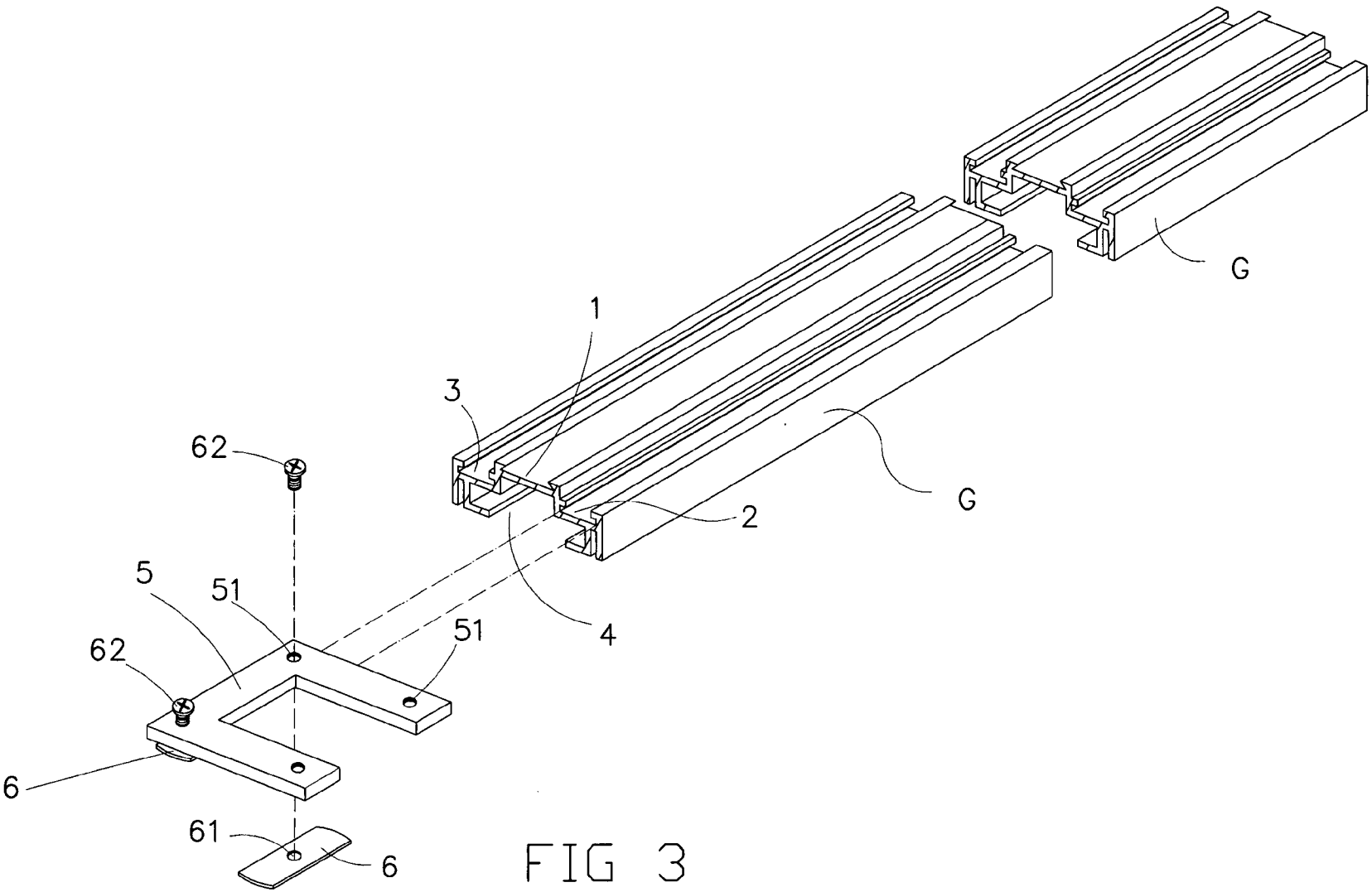
FIG. 3 is an exploded perspective view showing the relation between the base frame for fixture of the present invention and specially designed connecting bracket and inserting plates.
Figure 4:
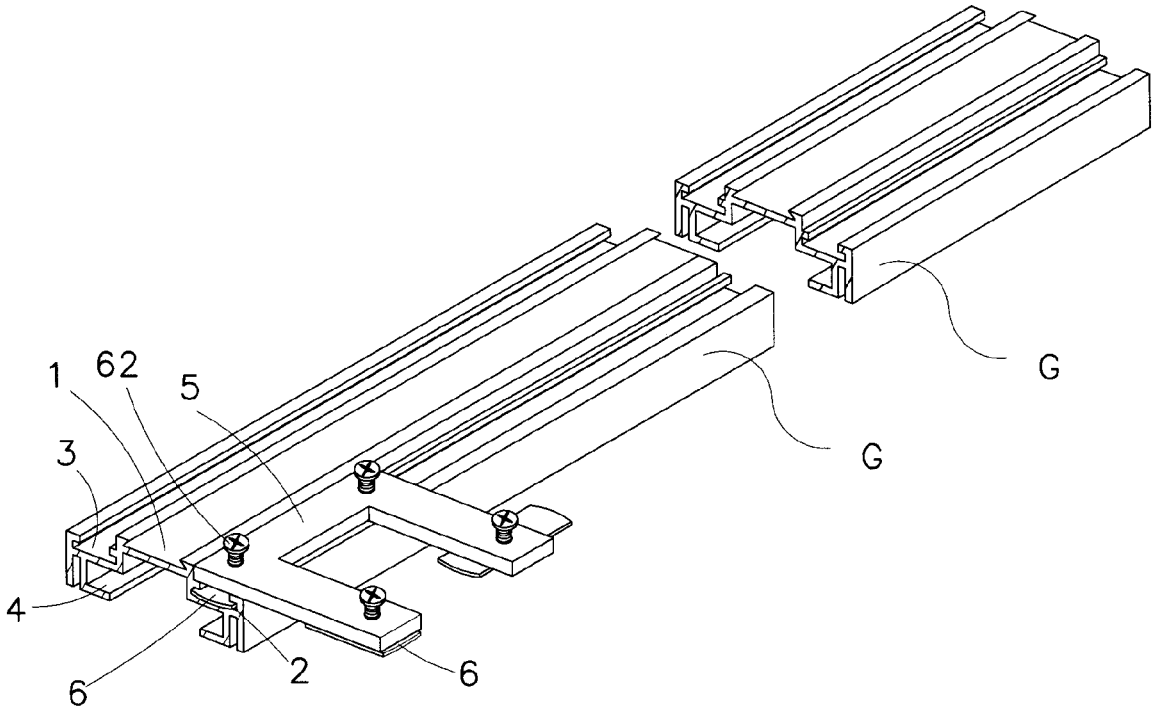
FIG. 4 is an assembled perspective view of FIG. 3.
Figure 7:
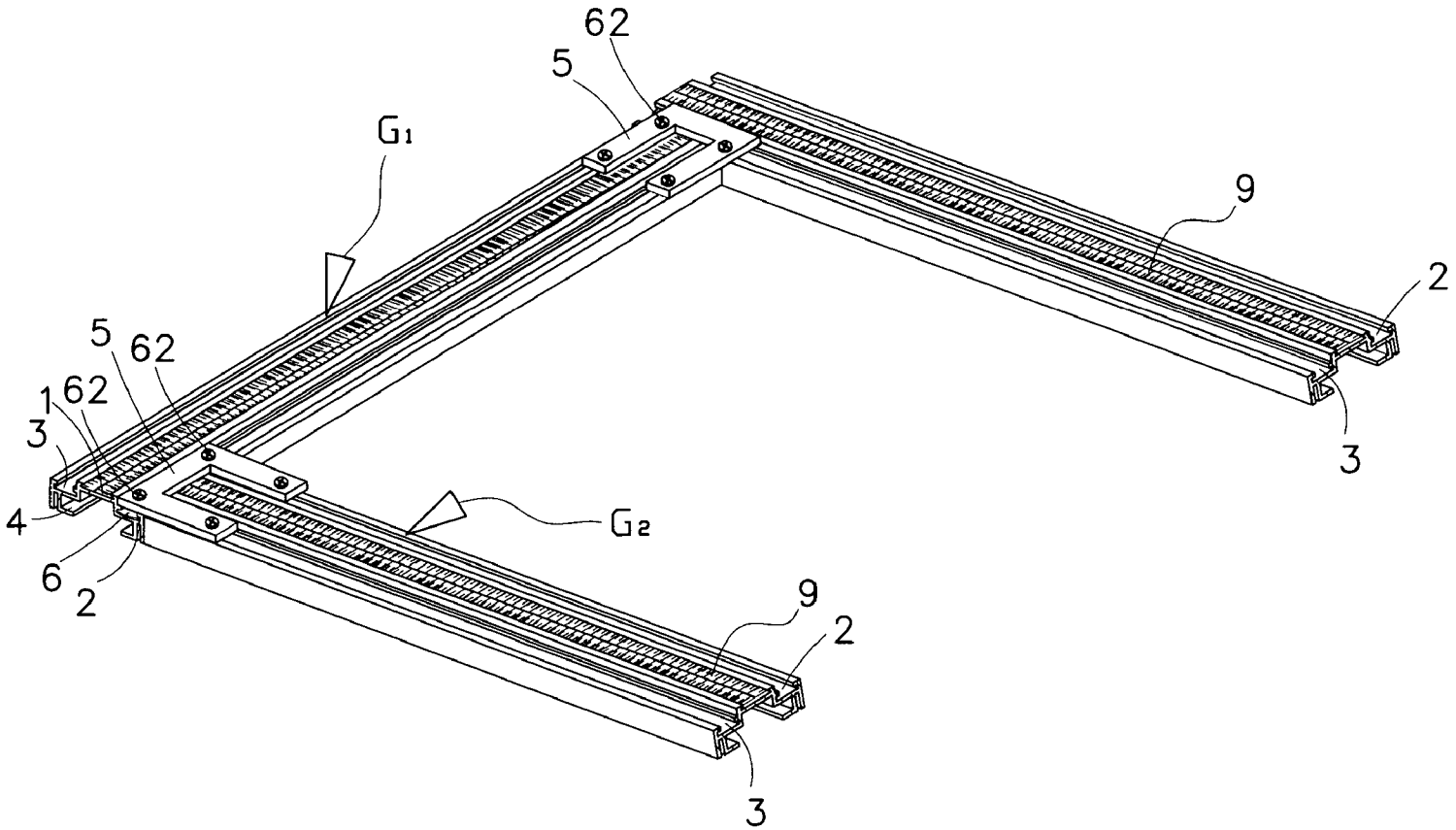
FIG. 7 is an assembled view showing two base frames for fixture of the present invention perpendicularly connected at adjacent edges using the connecting bracket and the inserting plates of FIG. 3.

Please now refer to FIGS. 3, 4, and 7. Two base frames $G_1$, $G_2$ of FIG. 2 may be perpendicularly connected to each other in the same plane at two adjacent edges using a connecting bracket 5 and a plurality of inserting plates 6 that are specially designed for this purpose. The connecting bracket 5 is a U-shaped member having a thickness equal to a height difference between a top of the upper channel 1 and a top of the side channel 2, 3, and having a plurality of internally threaded through holes 51 provided at predetermined positions. Each of the inserting plates 6 is provided at a predetermined position with an internally threaded through hole 61, and may be connected to a bottom side of the connecting bracket 5 using a screw 62 sequentially threaded through one of the through holes 51 on the connecting bracket 5 and the through hole 61 on the inserting plate 6.

As can be most clearly seen from FIG. 4, an assembly of the connecting bracket 5 and the inserting plates 6 may be associated with a first base frame $G_1$ by sliding two inserting plates 6 below a crossbar portion of the U-shaped connecting bracket 5 into the side channel 2 or 3, and another two inserting plates 6 below free ends of two leg portions of the U-shaped connecting bracket 5 into two side channels 2, 3 of a second base frame $G_2$, as shown in FIG. 7, so that the two base frames $G_1$, $G_2$ are connected to each other at their adjacent edges at a right angle. The screws 62 may then be tightened against the connecting bracket 5 and the inserting plates 6 to firmly connect the two base frames $G_1$, $G_2$ to one another. After the two base frames $G_1$, $G_2$ are connected together in the above manner, a top surface of the connecting bracket 5 is flush with the top of the dovetailed upper channel 1.

Figure 6:
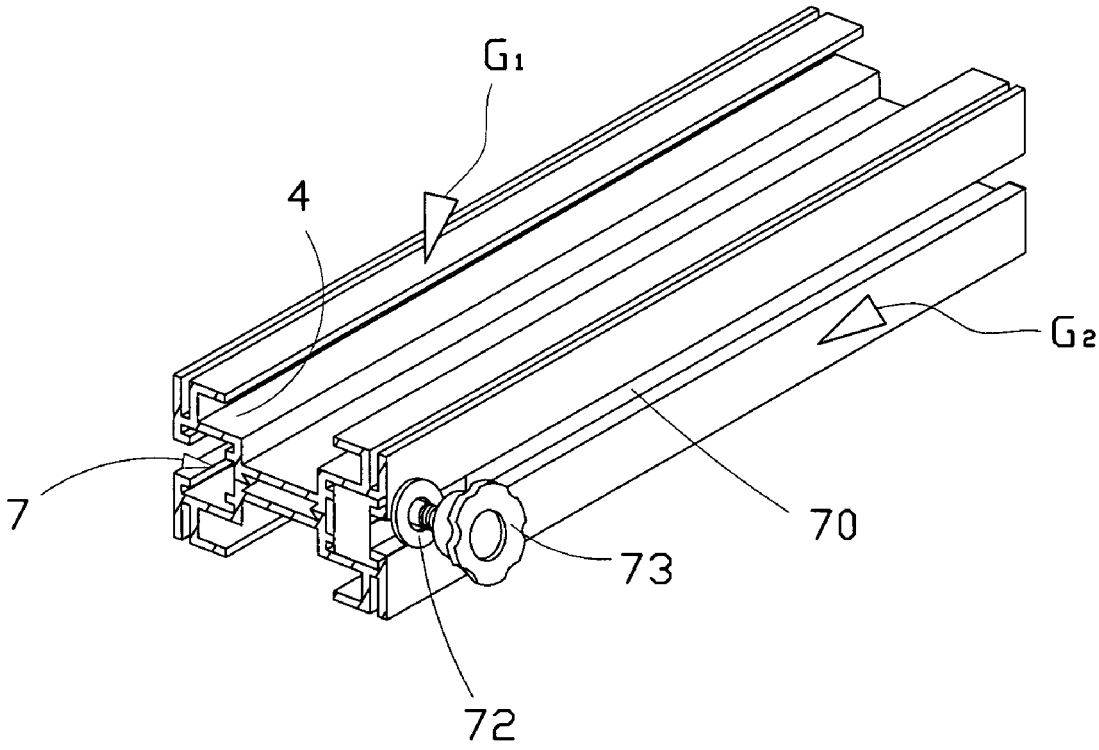
FIG. 6 is an assembled perspective view of FIG. 5.

Please refer to FIGS. 5 and 6. The two base frames $G_1$, $G_2$ of FIG. 2 may also be symmetrically superposed with the upper channels 1 facing toward each other, and then be tightly connected together using inserting blocks 71, washers 72, and knob-head bolts 73 that are specially designed for this purpose. As mentioned above, due to the height difference between the tops of the upper channel 1 and the side channel 2, 3, an open-sided channel 7 is formed between the side channels 2, 3 at the same side of the superposed base frames $G_1$, $G_2$.

The inserting block 71 has a cross section corresponding to that of the channel 7 for fitly sliding into the channel 7, and is provided at a predetermined position with an internally threaded through hole 711. The washer 72 has a central hole 721, and the knob-head bolt 73 is adapted to sequentially extend through the central hole 721 of the washer 72 and the threaded hole 711 of the inserting block 71. When the inserting block 71 has been slid into the channel 7 to a predetermined position, the knob-head bolt 73 may be extended through the washer 72 and the threaded hole 711 on the inserting block 71 to tighten the inserting block 71 and the washer 72 against an inner and an outer side, respectively, of a side opening 70 of the channel 7, as shown in FIG. 6, so that the two superposed base frames $G_1$, $G_2$ are firmly connected to each other.

Figure 8:
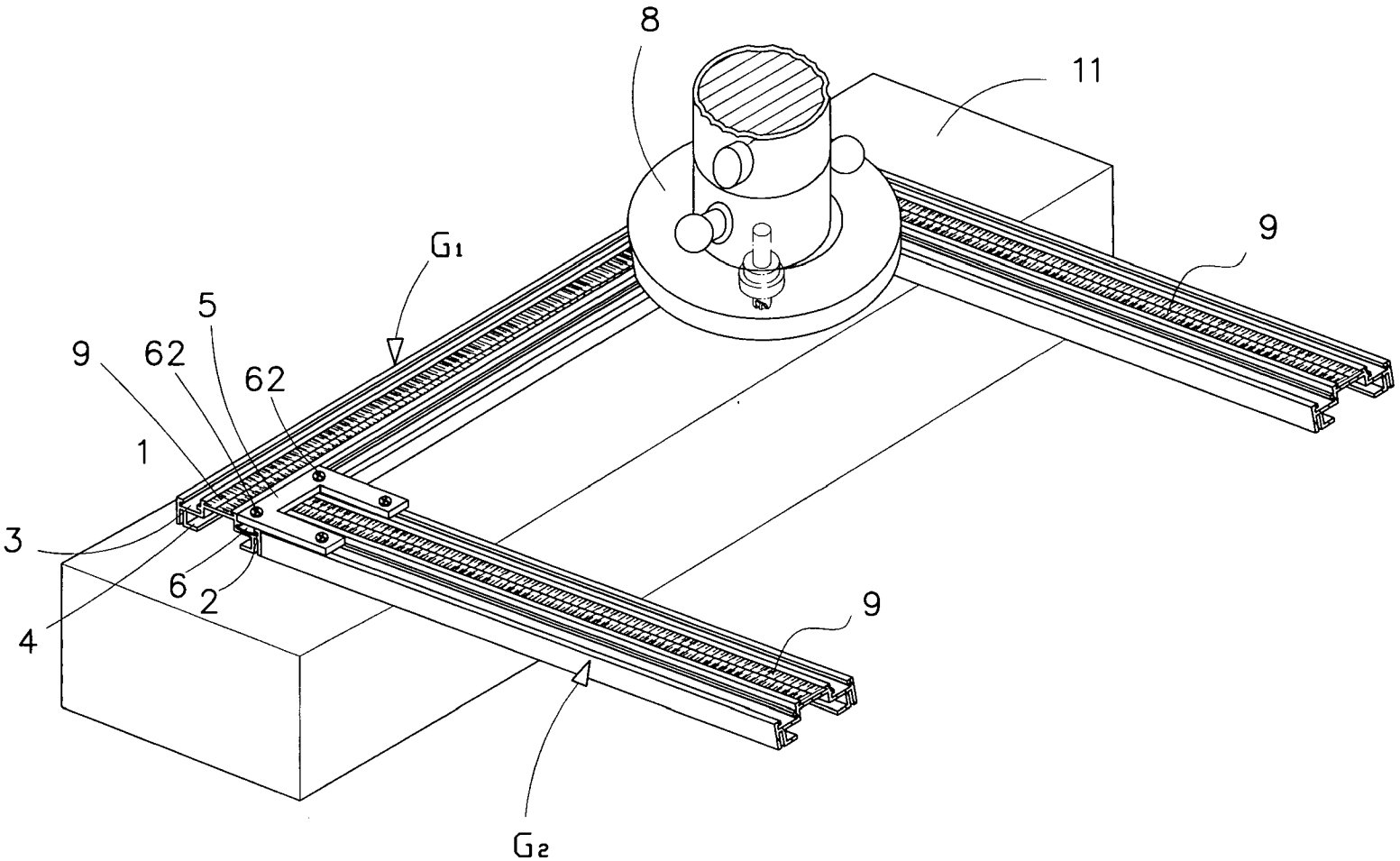
FIG. 8 shows a groove-milling machine works with the perpendicularly connected base frames for fixture of FIG. 7 to mill a groove on a workpiece.
Figure 9:
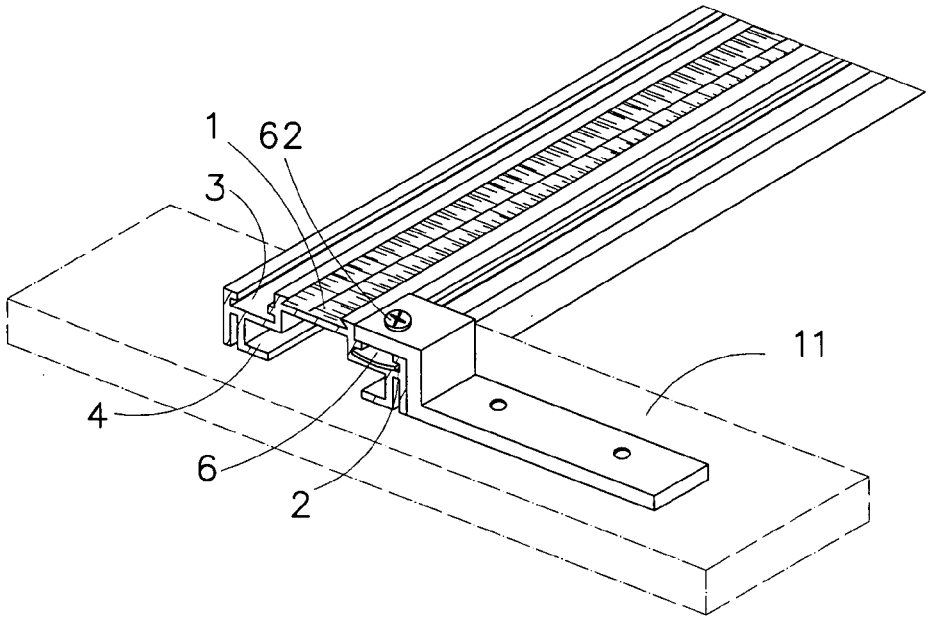
FIG. 9 shows an example of adjustably connecting the inserting plate to only one side channel of the base frame for fixture of the present invention for performing drilling work.
Figure 10:
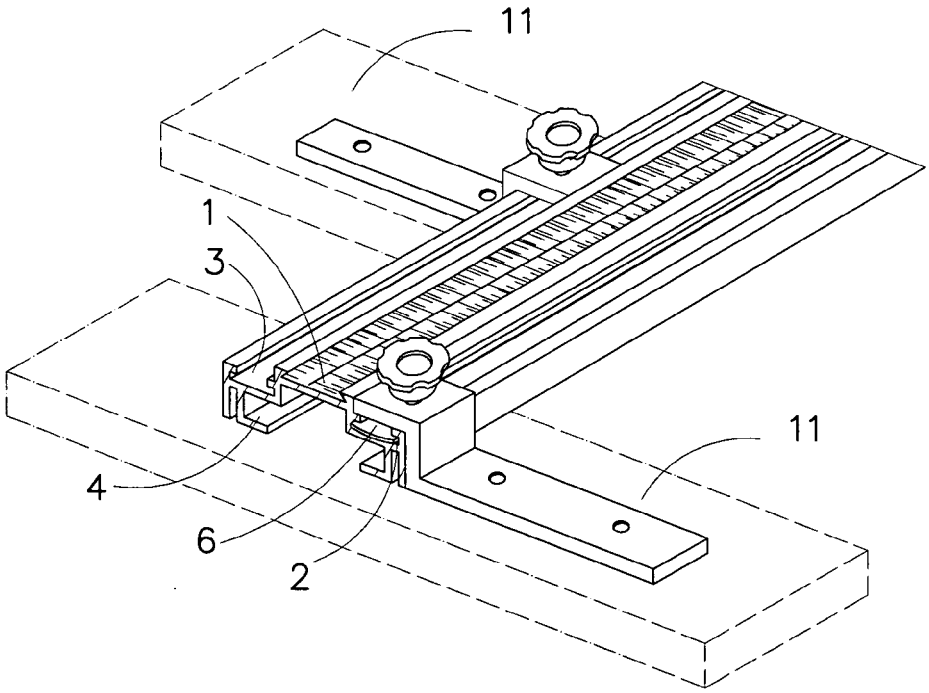
FIG. 10 shows another example of adjustably connecting two inserting plates to two opposite side channels of the same one base frame for fixture of the present invention for performing drilling work.
Figure 11:
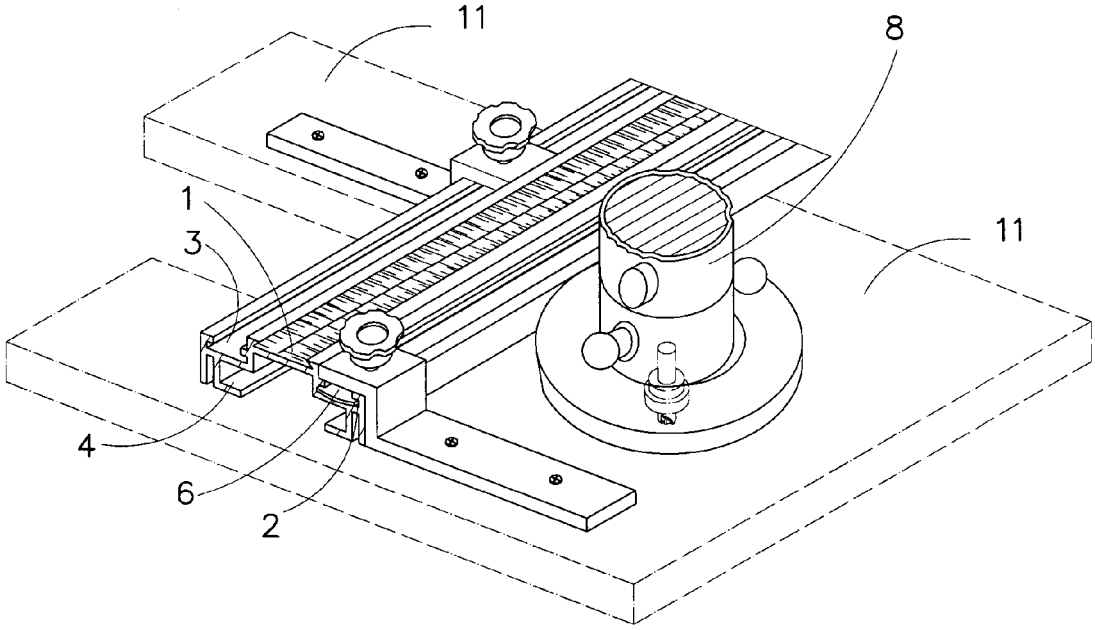
FIG. 11 shows a further example of adjustably connecting two inserting plates to two opposite side channels of the same one base frame for fixture of the present invention for performing groove-milling work.

FIG. 8 shows three base frames for fixture according to the present invention are sequentially connected to one another using the connecting brackets 5, the inserting plates 6, and the screws 62, and have flushed top surfaces, so that a groove-milling machine 8 may move on the flushed base frames $G_1$, $G_2$ to perform accurate groove-milling work. A tape measure 9 may be fitted in the upper channel 1 to facilitate accurate wood fabrication. Since both side channels 2, 3 allow two base frames $G_1$, $G_2$ to perpendicularly connect to one another at their adjacent edges, a user may select to perform the drilling work at one side of any base frame $G_1$ or $G_2$, as shown in FIG. 9, or to perform the drilling or the groove-milling work at two opposite sides of the base frame $G_1$ or $G_2$ at the same time, as shown in FIGS. 10 and 11.

Figure 13:
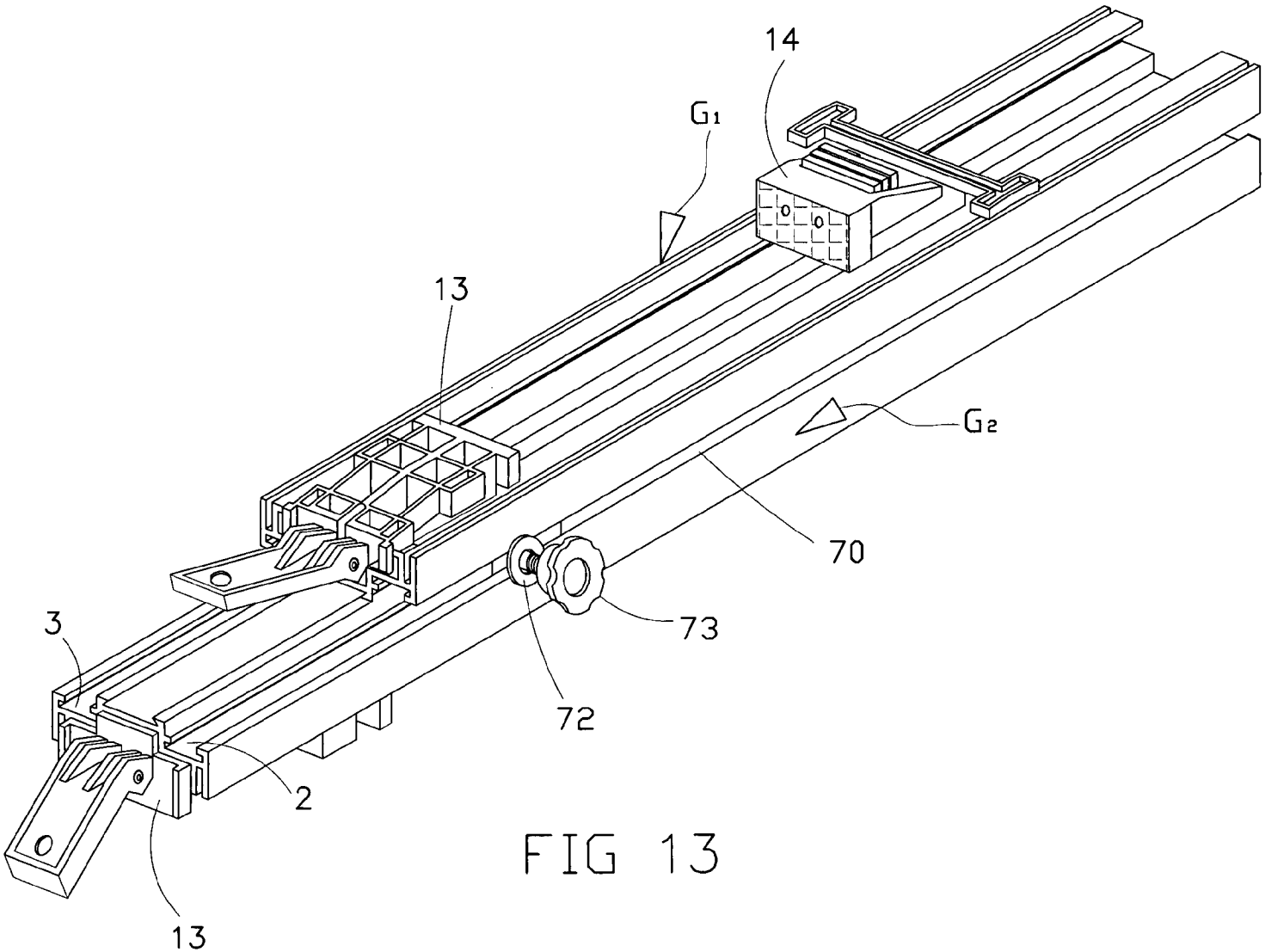
FIG. 13 shows the connection of different fixtures to two superposed base frames for fixture of the present invention.
Figure 14:
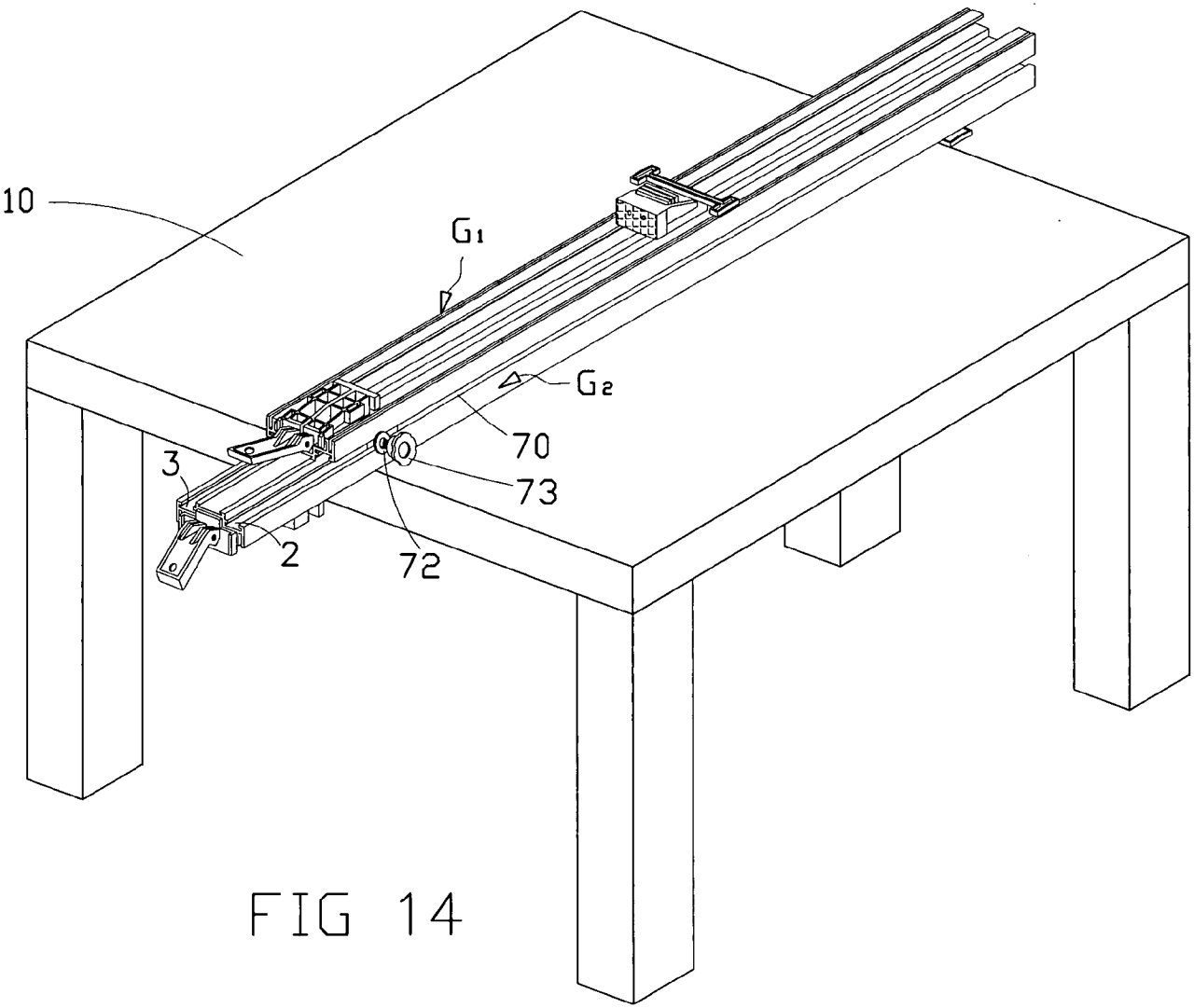
FIG. 14 shows the superposed base frames for fixture of the present invention of FIG. 13 are firmly fixed to a worktable.
Figure 15:
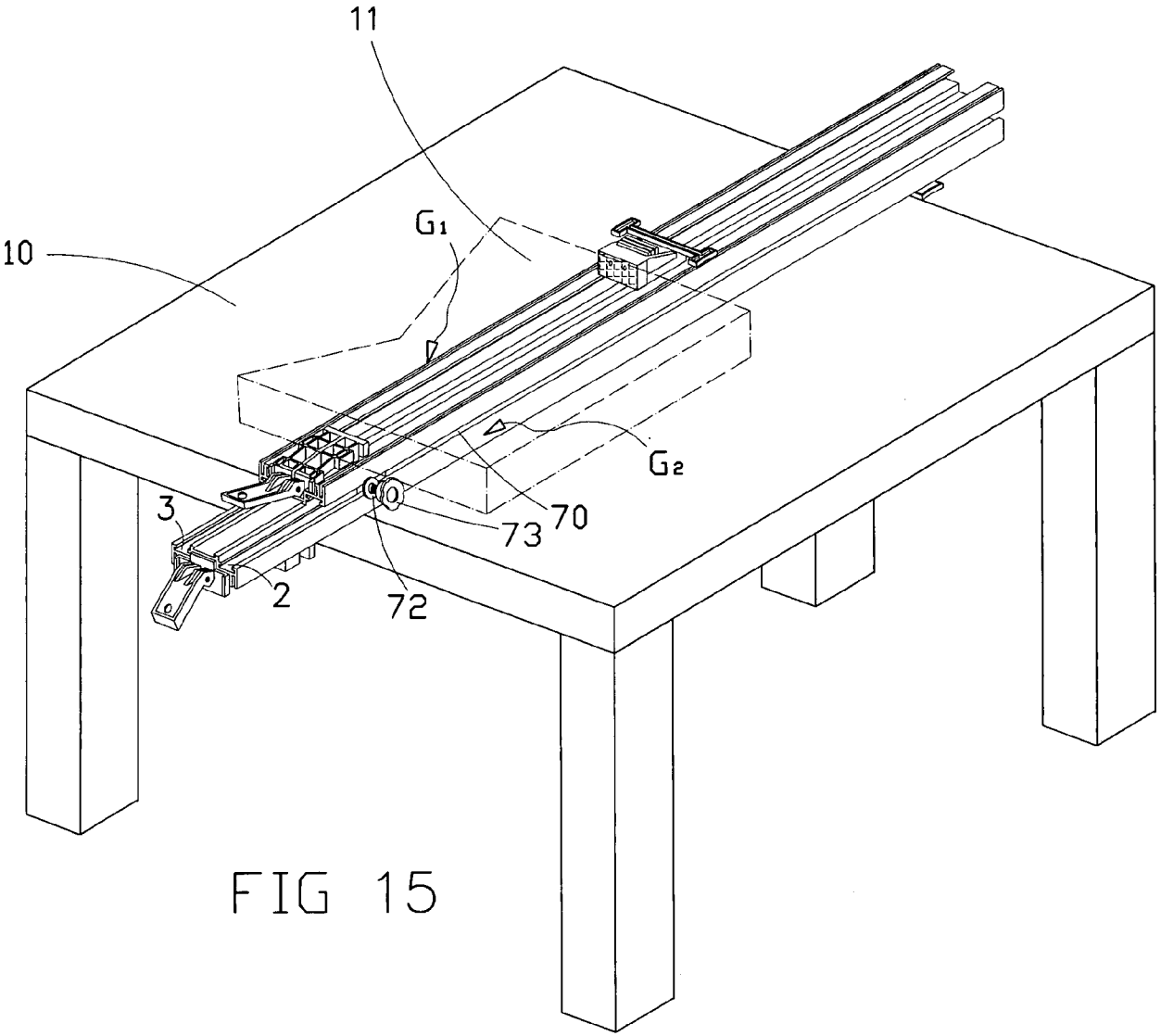
FIG. 15 shows a workpiece is tightly clamped between the fixtures connected to the superposed base frames for fixture of the present invention of FIG. 14.

Please refer to FIGS. 13, 14, and 15. When two base frames $G_1$, $G_2$ are symmetrically superposed and firmly connected, as shown in FIG. 13, the lower base frame $G_2$ may be fixedly mounted on a worktable 10 using fixtures 13, 14, as shown in FIG. 14. Meanwhile, another fixtures 13, 14 may be engaged with the lower channel 4 of the upper base frame $G_1$ for tightly clamping a workpiece 11 between them, as shown in FIG. 15, so that woodwork may be performed on the workpiece 11.

Figure 12:
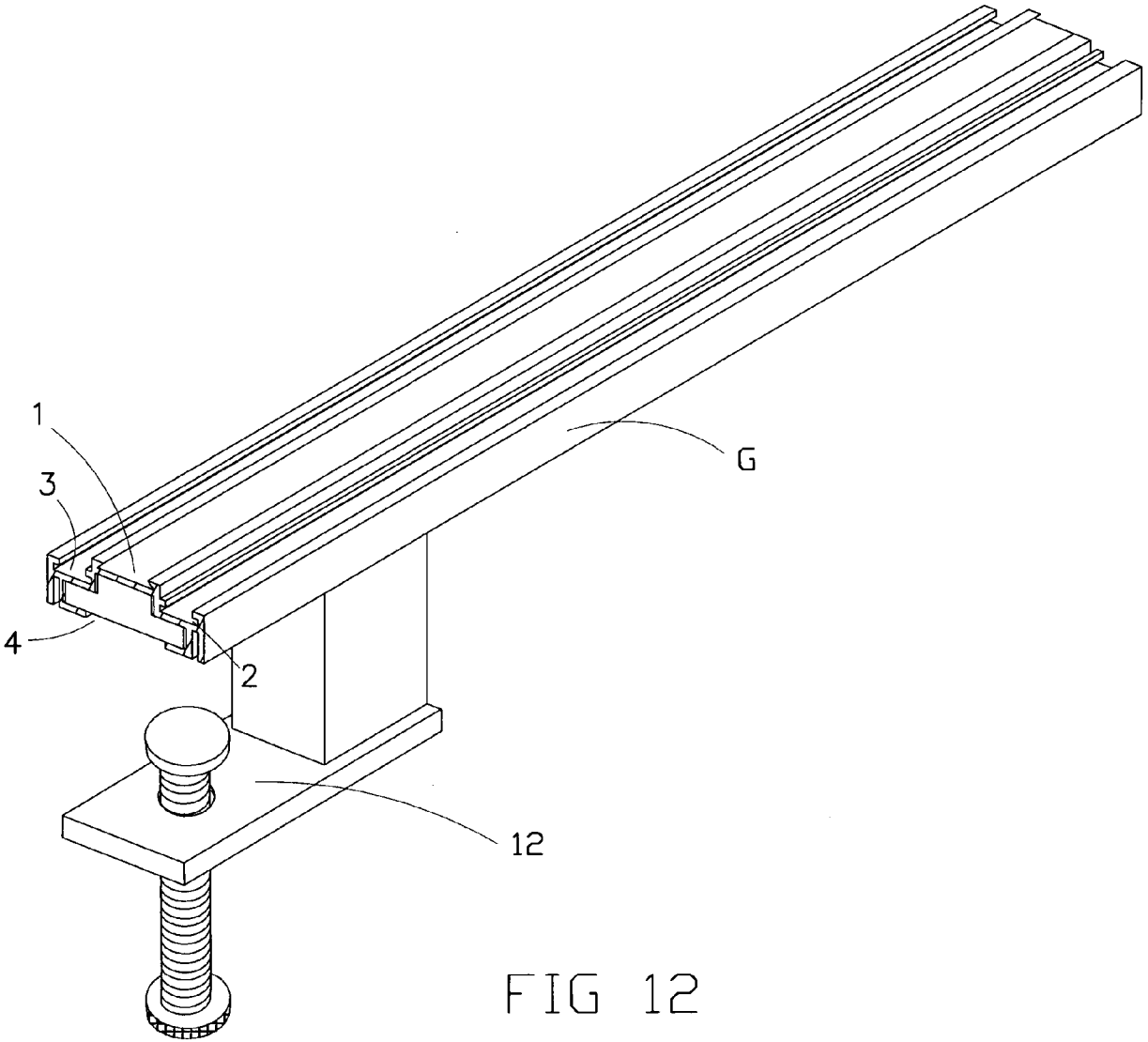
FIG. 12 shows a C-shaped clamp is removably connected to a bottom channel of the base frame for fixture of the present invention.

Please refer to FIG. 12. A C-shaped clamp 12 having a top configuration corresponding to a cross section of the lower channel 4 is specially designed for firmly connecting the base frame G to the worktable 10. More specifically, the C-shaped clamp 12 is adjustably connected to the base frame G through engagement of the top of the C-shaped clamp 12 with the lower channel 4 of the base frame G, and a lower part of the C-shaped clamp 12 is then tightly mounted to the worktable 10 via, for example, a bolt.

What is claimed is:

1. A base frame for fixture, comprising:

an extruded body having a raised top central portion and a lowered wing portion at each lateral side of said raised top central portion, said top central portion being an open-topped upper channel in the form of a dovetail groove having a predetermined depth, said two lowered lateral wing portions being formed into two symmetrically identical open-topped side channels, and a big-size open-bottomed lower channel being formed below said upper channel and said two side channels;

a plurality of U-shaped connecting brackets having a crossbar portion and two leg portions that have a thickness equal to a height difference between a top of said upper channel and a top of said side channel, and a plurality of internally threaded through holes provided on said connecting bracket at predetermined positions;

a plurality of inserting plates having a cross section corresponding to that of said side channels and adapted to slide into said side channels, and an internally threaded through hole provided at a predetermined position;

a plurality of screws adapted to sequentially thread into said threaded through holes on said connecting bracket and said inserting plate, so that an assembly of one said connecting bracket and at least four said inserting plates may be formed;

a plurality of inserting blocks having a predetermined cross section, and being provided at a predetermined position with an internally threaded through hole;

a plurality of washers having a central hole; and a plurality of knob-head bolts adapted to sequentially thread through said central hole of said washer and said threaded through hole of said inserting block.

2. The base frame for fixture as claimed in claim 1, wherein two said base frames may be connected to each other at two adjacent edges at a right angle by sliding two said inserting plates below said crossbar portion of said U-shaped connecting bracket into one said side channel on a first one of said two base frames, and another two said inserting plates below free ends of said two leg portions of said U-shaped connecting bracket into two said side channels on a second one of said two base frames, and then tightening said screws against said U-shaped connecting bracket and said inserting plates to firmly connect said connecting bracket to said two base frames that are perpendicular to each other in the same plane now.

3. The base frame for fixture as claimed in claim 1, wherein two said base frames may be symmetrically superposed with and connected together with two said upper channels facing toward each other, so that a channel is formed between two said side channels at the same side of said two superposed base frames.

4. The base frame for fixture as claimed in claim 3, wherein said channel formed between two said side channels at the same side of said two superposed base frames is an open-sided channel having a side opening.

5. The base frame for fixture as claimed in claim 1, wherein said predetermined cross section of said inserting block is corresponding to a configuration of said channel formed between two said side channels at the same side of said two superposed base frames.

* * * * *